United States Patent [19]

Lazaroff

[11] 4,255,950

[45] Mar. 17, 1981

[54] LIQUID CONTROL SYSTEM SPRAY WASHER

[76] Inventor: Gary G. Lazaroff, 1320 White Orchard La., St. Louis, Mo. 63141

[21] Appl. No.: 40,490

[22] Filed: May 21, 1979

[51] Int. Cl.[3] ..... D06F 31/00; D06F 39/10

[52] U.S. Cl. ..... 68/18 F; 68/27; 68/205 R; 134/60; 210/167; 210/254

[58] Field of Search ..... 68/18 F, 205 R, 27, 68/208; 134/60; 210/167, 254, 262

[56] References Cited

U.S. PATENT DOCUMENTS

| | | | |
|---|---|---|---|
| 1,029,541 | 6/1912 | Haustetter | 134/60 |
| 1,527,369 | 2/1925 | Meyer | 68/205 R X |
| 3,470,571 | 10/1969 | Hrboticky | 68/205 R X |
| 3,911,701 | 10/1975 | Zeiffer | 68/18 F |

FOREIGN PATENT DOCUMENTS

| | | | |
|---|---|---|---|
| 529588 | 9/1921 | France | 68/205 R |

*Primary Examiner*—Philip R. Coe
*Attorney, Agent, or Firm*—Cohn, Powell & Hind

[57] ABSTRACT

A spray washing system for garments including at least three spray stations for spraying garments passing through the spray stations. Each spray station has a liquid tank and a pump which has an inlet located in the associated tank. Liquid is introduced into the tank of the first spray station. Pipes interconnect the tanks of the first spray station and the second spray station, and the tanks of the second spray station and the third spray station for feeding liquid sequentially from the first spray station to the third spray station. The sequential flow of liquid between the tanks of the spray stations is opposite to the sequence of passage of the garments through the spray stations. Liquid is introduced continuously in the tank of the first spray station, and liquid is fed continuously to the sequentially interconnected spray stations. The pipes interconnecting the spray stations are overflow pipes. A filter is located within each tank to provide a liquid-filtered compartment and a liquid-unfiltered compartment. The pumps for each spray station have their inlets located in the liquid-filtered compartments of the associated tank. The overflow pipes interconnect the liquid-unfiltered compartments of the tanks, and provide for flow of liquid regardless of any blocking of the filters and lowering of liquid levels in the liquid-filtered compartments.

1 Claim, 3 Drawing Figures

LIQUID CONTROL SYSTEM SPRAY WASHER

BACKGROUND OF THE INVENTION

This invention relates generally to a spray washing system for garments, and particularly to a control system for sequentially feeding liquid to a series of spray stations.

The prior art teaches the feature of supplying make-up liquid from a first spray station to other spray stations on demand. This feature results in a waste of water as the relatively clean liquid from the first spray station is used as make-up water in both the early and later spray stations.

The prior art also teaches the use of a pump for supplying the make-up liquid from the first spray station. The use of a pump in this manner requires the expenditure of both the capital investment and the maintanence of cost associated with the pump.

SUMMARY OF THE INVENTION

The present spray washing system for garments provides a sequential liquid overflow system between spray stations which both conserves the use of water and does not require the use of a pump.

The present spray washing system includes a plurality of spray stations for spraying garments passing through the spray stations. Each spray station has a liquid tank, and a pump which includes an inlet located in the associated tank. The pump is used for spraying the garments as they pass through the associated spray station. Means are provided for introducing liquid into the tank of a first spray station. Means interconnect the tanks of the first spray station and a second spray station, and interconnect the tanks of the second spray station and a third spray station for feeding liquid sequentially from the first spray station to the third spray station.

The sequential flow of liquid between the tanks of the spray stations is opposite to the sequential passage of garments through the spray stations. The means for introducing liquid operates to continuously introduce liquid into the tank of the first spray station, while the means interconnecting the tanks feeds liquid continuously and sequentially between the spray stations.

The means interconnecting the tanks includes overflow pipes interconnecting the tanks of the first and second spray stations, and the tanks of the second and third spray stations.

In one aspect of the invention, a filter is located within each tank to provide a liquid-filtered compartment and a liquid-unfiltered compartment. The pump for each spray station has its inlet located in the liquid-filtered compartment of the associated tank.

In one aspect, the interconnecting pipes interconnect the liquid-filtered compartment of the first and second spray stations to provide for the flow of liquid regardless of any blocking of the filters and lowering of liquid levels in the liquid-filtered compartments.

In one aspect of the invention, the overflow pipe bridges the liquid-filtered compartment of the tank of the associate spray station.

DESCRIPTION OF THE PREFERRED EMBODIMENT

Figure 1:
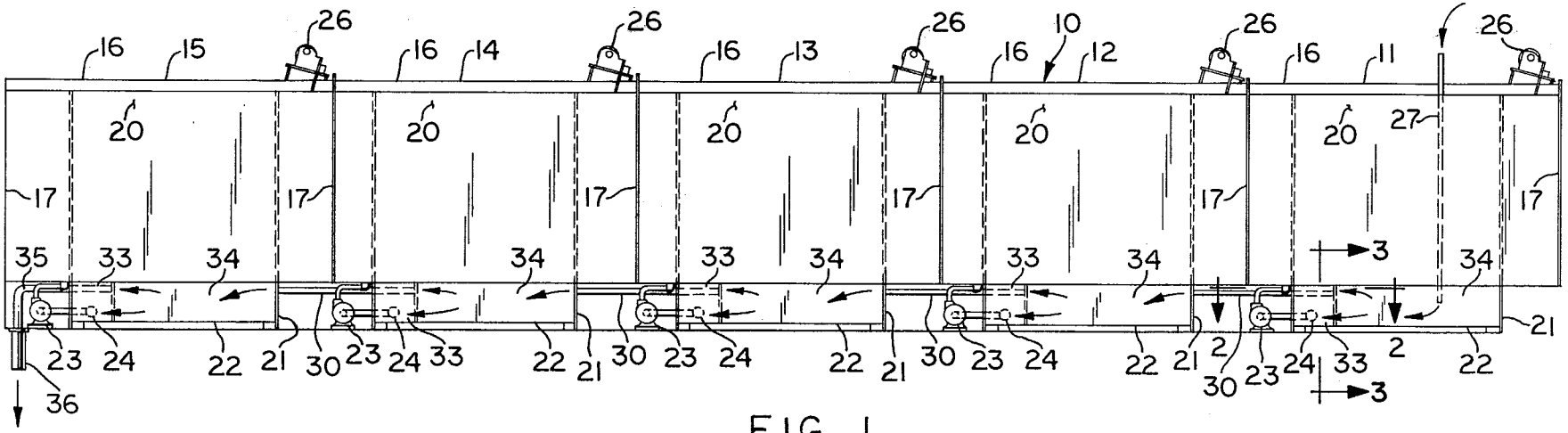
FIG. 1 is a side elevational view of the spray stations.
Figure 2:
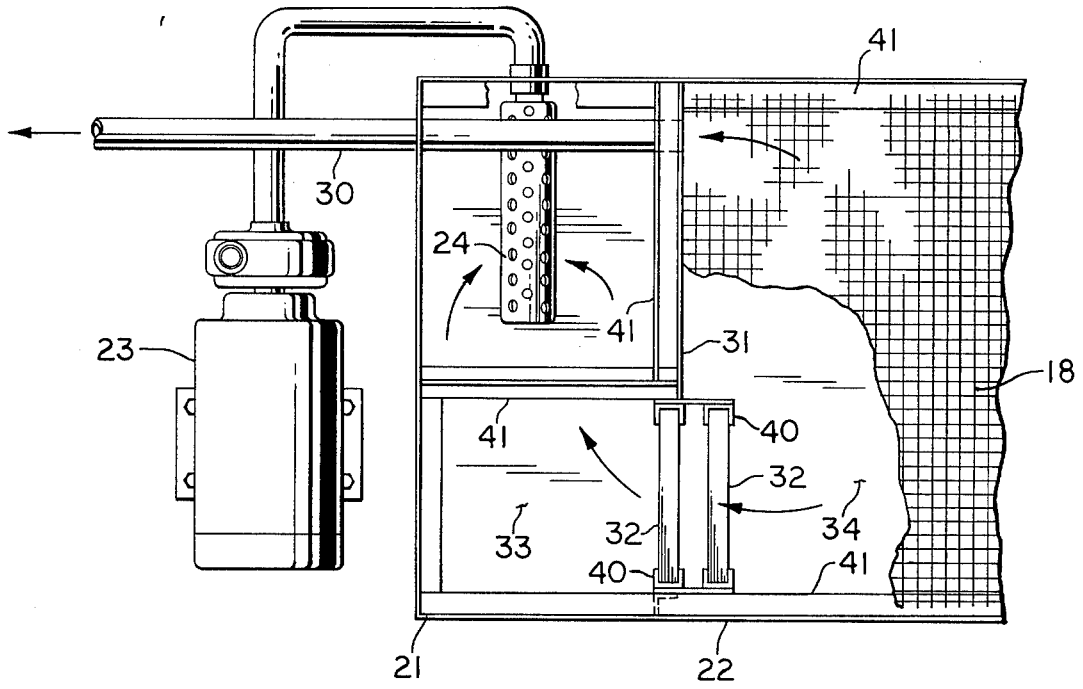
FIG. 2 is an enlarged, fragmentary sectional view taken on line 2—2 of FIG. 1.
Figure 3:
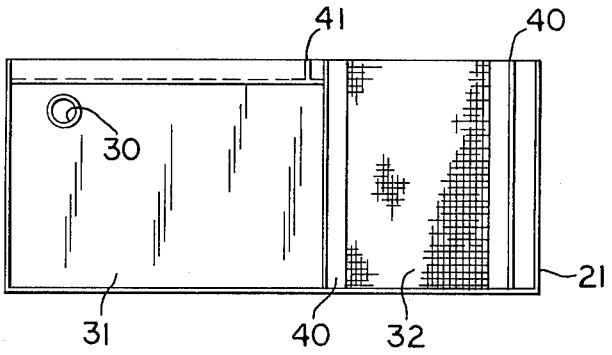
FIG. 3 is an enlarged sectional view taken on line 3—3 of FIG. 1.

Referring now by characters of reference to the drawings and first to FIG. 1, a spray washing system for garments includes a plurality of spray stations, generally indicated by 10, for spraying garments (not shown) passing through the spray stations 10. In the preferred embodiment, there are five (5) spray stations numbered 11 through 15 consecutively. The spray stations 10 include top walls 16, end walls 17, side walls 20 and bases 21. Each of the spray stations 10 includes a liquid tank 22 located within the base 21. Each spray station 10 includes a pump 23 having an inlet 24 located within the associated tank 22. Each tank 22 is covered by a filter screen 18. The pumps 23, pump liquid from the tanks 22 for spraying garments within the spray stations 10. A motor assembly 26 is provided for each spray station 10 to oscillate the liquid spray within the spray station 10.

The over spray of the liquid sprayed within the spray stations 10 passes through the filter screen 18 and is collected in the tanks 22. A pipe 27 constitutes means for introducing liquid into the tank of the first spray station 11. An overflow pipe 30 constitutes means interconnecting the tanks 22 of the first spray station 11 and second spray station 12. The tanks 22 of the second and third spray stations 12 and 13 respectively, the third and fourth spray stations 13 and 14, and the fourth and fifth spray stations 14 and 15 respectively are, likewise, interconnected by overflow pipes 30.

The overflow pipes 30 provide for sequential feeding of liquid from the first spray station 11, and to the second, third, fourth and fifth spray stations, 12 through 15 respectively.

The sequential flow of liquid between the tanks 22 of the spray stations 10 is opposite to the sequence of passage of garments through the spray stations 10. Garments (not shown) pass through, in sequence, the fifth, fourth, third, second and first spray stations 15, 14, 13, 12 and 11 respectively. The sequence of liquid flow is, therefore, counterflowing to the sequence of passage of the garments through the spray stations 10.

In the preferred embodiment, the liquid is continuously introduced into the tank 22 of the spray station 11 to provide for continuous sequential feeding of liquid between the spray stations 10. The liquid flows through the overflow pipes 30 under the force of gravity.

The tanks 22 are provided with walls 31 and filters 32 to divide the tanks 22 into liquid-filtered compartments 33 and liquid-unfiltered compartments 34. Channels 40 support filters 32. Additional structural members 41 provide support for the tank 22 and wall 31. The pump inlets 24 are located in the liquid-filtered compartments 33 of the associated tanks 22. The overflow pipes 30 interconnect the liquid-unfiltered compartments 34 of the tanks 22. This overflow pipe assembly provides for feeding of liquid through the overflow pipes 30 regardless of any blocking of the filters 32 and any lowering of liquid levels in the liquid-filtered compartments 33. The overflow pipes 30 are connected through the walls 31 of the tanks 22. The overflow pipes 30 bridge the associated liquid-filtered compartments 33 and receive liquid from the associated liquid-unfiltered compartment 34.

A drain overflow pipe 35 interconnects the tank 22 of the fifth spray station 15 with a drain 36, thereby disposing of dirty liquid from the final spray station 10 in the sequential flow of liquid.

It is thought that the structural features and functional advantages of this spray washing system have become fully apparent from the foregoing description of parts, but for completeness of disclosure the operation of the system will be briefly discussed.

Garments (not shown) to be sprayed pass through the spray stations 15, 14, 13, 12 and 11 in sequence. At each spray station 10, the pump 23 draws liquid from the liquid-filtered compartment 33 of the tanks 22. This liquid is sprayed on the garments within the spray station 10.

Fresh liquid, such as water with or without additive chemicals, is introduced into the tank 22 of the spray station 11 through the liquid pipe 27. The tank 22 of spray station 11 therefore collects both water over spray from garments within the spray station 11, and the continuous flow of water from the liquid pipe 27. Because the spray station 11 is the final rinse station for garments, the water running off the garments is relatively clean. Hence, the liquid in tank 22 of spray station 11 is relatively clean. Water in the tank 22 of spray station 11 overflows through the overflow pipe 30 into the tank 22 of the spray station 12. The liquid in the tank 22 of spray station 12 is slightly dirtier than that of the spray station 11 and because it is receiving overflow liquid from the spray station 11 and not fresh clean water of the quality received in the spray station 11.

Similarly, liquid overflows from the tank 22 of spray station 12 to the tank 22 of the spray station 13.

In a similar manner, the liquid overflows through the pipes 30 to the tanks 22 of the spray stations 14 and 15. The water in the tanks 22 of the spray stations 13, 14 and 15 is progressively dirtier. It is not necessary that the spray water of the early spray stations 14 and 15 be as clean as the water of the spray station 12 and 11, therefore this spray wash system utilizes the dirtier water in the early spray stations 10 to conserve the use of clean water. Water from the tank 22 of the spray station 15 overflows through a drain overflow pipe 35 to a drain 36.

The pump intakes 25 are located within the liquid-filtered compartments 33 of the respective tanks 22 while the overflow pipes 30 communicate directly with the liquid-unfiltered compartments 34 of the tanks 22. This provides for continuous flow of liquid from spray station to spray station regardless of any blocking of the filters 32. If the intakes for the overflow pipes 30 were located within the liquid-filtered compartments 33, and a filter 32 became blocked, the pump 23 would draw down the liquid level in the liquid-filtered compartments 33, and the liquid overflow from that tank 22 would cease, depriving sequentially connected spray stations 10 from overflow liquid. The liquid overflow from interconnected tanks 22 is therefore continuous when the spray stations 10 are in operation.

I claim as my invention:

1. A spray washing system for garments including a plurality of spray stations for spraying garments passing through the spray stations, comprising:

(a) a liquid tank for each spray station, (b) a filter located within each tank to provide a liquid-filtered compartment and a liquid-unfiltered compartment, said filter extending substantially across the path of liquid passing between said compartments, (c) a pump for each spray station including an intake located in the liquid-filtered compartment of the associated tank, (d) means for introducing liquid into the tank of one spray station, (e) means interconnecting the liquid-unfiltered compartment of the tank of the said one spray station with the tank of a second spray station for feeding liquid from the tank of the said one spray station to the tank of the second spray station, (f) the interconnecting means including an overflow pipe interconnecting the liquid-unfiltered compartments of the tanks of the said one and second spray stations, the overflow pipe providing for the flow of liquid regardless of any blocking of the filters and lowering of liquid levels in the liquid-filtered compartments, (g) the overflow pipe bridging the liquid-unfiltered compartment of the tank of the said one spray station, (h) a generally vertical, substantially imperforate wall located within each tank, the wall and the filter cooperating to divide the tank into the liquid-filtered compartment and the liquid-unfiltered compartment, and (i) the overflow pipe being connected to the liquid-unfiltered compartment of the tank of said second spray station through said wall of said one spray station.

* * * * *